US012397986B2

(12) United States Patent
Bisinger

(10) Patent No.: US 12,397,986 B2
(45) Date of Patent: Aug. 26, 2025

(54) COLLAPSIBLE CONTAINERS INCLUDING EDGE ATTACHMENT BRACKETS

(71) Applicant: PRO blanket bars GmbH, Bisingen (DE)

(72) Inventor: Timo Bisinger, Geislingen (DE)

(73) Assignee: Pro Blanket Bars GMBH, Bisingen (DE)

( * ) Notice: Subject to any disclaimer, the term of this patent is extended or adjusted under 35 U.S.C. 154(b) by 187 days.

(21) Appl. No.: 18/223,233

(22) Filed: Jul. 18, 2023

(65) Prior Publication Data

US 2023/0356930 A1 Nov. 9, 2023

Related U.S. Application Data

(63) Continuation-in-part of application No. 17/155,683, filed on Jan. 22, 2021, now Pat. No. 11,731,805.

(51) Int. Cl.
*B65D 88/52* (2006.01)
*B65D 90/08* (2006.01)

(52) U.S. Cl.
CPC ..... *B65D 90/08* (2013.01); *B65D 88/526* (2013.01)

(58) Field of Classification Search
CPC ..... B65D 90/08; B65D 88/526
USPC ..... 206/600; 220/4.33
See application file for complete search history.

(56) References Cited

U.S. PATENT DOCUMENTS 2,526,113 A * 10/1950 Blackwell ..... B65D 85/305 217/65
3,266,656 A * 8/1966 Kridle ..... B65D 9/12 220/684
3,477,604 A * 11/1969 Kridle ..... B65D 9/12 217/12 R
3,989,156 A 11/1976 Lowry
4,024,977 A 5/1977 Rowley
4,796,392 A 1/1989 Graham, Jr.
5,114,194 A 5/1992 Toifl et al.
5,236,099 A * 8/1993 Fties ..... B65D 19/0016 220/4.31
5,253,763 A 10/1993 Kirkley et al.
D347,092 S * 5/1994 Ravel ..... D30/118
5,429,259 A * 7/1995 Robin ..... B65D 9/34 217/65
5,555,980 A 9/1996 Johnston et al.
5,566,849 A * 10/1996 Goehner ..... B65D 9/14 220/6

(Continued)

FOREIGN PATENT DOCUMENTS

EP 0455875 B1 3/1995

*Primary Examiner* — Jacob K Ackun

(74) *Attorney, Agent, or Firm* — Andrus Intellectual Property Law, LLP

(57) ABSTRACT

A container that is formed from a plurality of panels that are joined to each other by a plurality of edge brackets. Each of the edge brackets includes a first channel member and a second channel member that are joined to each other. The first channel member includes a first receiving channel and the second channel member includes a second receiving channel. The first and second receiving channels are arranged to be perpendicular to each other and are each sided to receive a side edge of one of the panels that form the container. The series of edge brackets can be used to securely assembly the container from the plurality of panels after the disassembled container has been shipped.

16 Claims, 13 Drawing Sheets

(56) References Cited

U.S. PATENT DOCUMENTS

| | | | | |
|---|---|---|---|---|
| 5,597,084 | A | 1/1997 | Parasin | |
| 5,722,551 | A * | 3/1998 | Cocciemiglio, Jr. | B65D 9/24 220/4.33 |
| 6,315,495 | B1 | 11/2001 | Starheim | |
| D460,263 | S * | 7/2002 | Bradford | D3/318 |
| 6,443,508 | B1 | 9/2002 | Persson | |
| 6,554,148 | B1 * | 4/2003 | Fernandez | B65D 11/1873 220/4.33 |
| 6,749,077 | B1 | 6/2004 | McAlpine et al. | |
| 6,799,691 | B2 | 10/2004 | Wincent | |
| 7,428,973 | B2 | 9/2008 | Barth et al. | |
| 7,552,826 | B2 | 6/2009 | Watanabe | |
| 7,591,053 | B2 * | 9/2009 | Bosisio | E04H 13/006 27/35 |
| 7,753,222 | B1 | 7/2010 | Heinrichs | |
| 8,028,849 | B2 | 10/2011 | Hall | |
| 8,083,448 | B2 | 12/2011 | Heinrichs et al. | |
| 8,672,137 | B2 | 3/2014 | Seagle et al. | |
| 8,708,178 | B2 | 4/2014 | Kvols et al. | |
| 8,813,985 | B2 | 8/2014 | Scholesser | |
| 8,915,390 | B2 * | 12/2014 | Meyer-Horn | B65D 9/24 217/43 A |
| 10,060,455 | B2 | 8/2018 | Munch-Fals | |
| 10,858,167 | B2 * | 12/2020 | D'Anglade | B65D 71/0096 |
| 11,731,805 | B2 * | 8/2023 | Bisinger | B65D 19/20 206/600 |
| 2002/0040903 | A1 * | 4/2002 | Coones | B65D 9/12 220/4.33 |
| 2002/0139798 | A1 | 10/2002 | Logan et al. | |
| 2004/0131416 | A1 * | 7/2004 | Wu | A47B 47/0033 403/170 |
| 2004/0208689 | A1 | 10/2004 | Dijkstra | |
| 2006/0226143 | A1 | 10/2006 | Elstone et al. | |
| 2007/0000923 | A1 * | 1/2007 | Chen | B65D 19/06 220/4.33 |
| 2011/0194893 | A1 | 8/2011 | Wiebe | |
| 2013/0315652 | A1 | 11/2013 | Eding | |
| 2014/0110404 | A1 | 4/2014 | Wiebe | |
| 2016/0195118 | A1 | 7/2016 | Munch-Fals et al. | |

* cited by examiner

COLLAPSIBLE CONTAINERS INCLUDING EDGE ATTACHMENT BRACKETS

CROSS REFERENCE TO RELATED APPLICATION

The present application is a continuation-in-part and claims priority to U.S. patent application Ser. No. 17/155,683, filed Jan. 22, 2021, the disclosure of which is incorporated herein by reference.

FIELD

The present disclosure relates to containers used for shipping cargo and specifically to collapsible and reusable containers. More specifically, the present disclosure relates to collapsible containers that includes edge attachment brackets that each join two sides or panels of the collapsible container.

BACKGROUND

Collapsible containers are commonly used in the shipping industry to transport cargo. Collapsible containers may be reused to reduce waste disposal costs associated with "single-use" shipping containers. Furthermore, collapsible containers may reduce storage space necessary when the containers are not in use.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a container includes a first panel with a detent and a pin extending therefrom, a second panel that extends transverse to the first panel, and a bracket removably coupled to the first panel via engagement with the detent and the pin such that the bracket prevents movement of the second panel relative to the first panel. The detent is selectively depressed to thereby decouple the bracket from the first panel.

In certain examples, a container includes a first panel with a detent, a first pin, and a second pin extending therefrom and a second panel that extends transverse to the first panel. A bracket is removably coupled to the first panel via engagement with the detent, the first pin, and the second pin such that a first arm of the bracket is coupled to the first panel and a second arm of the bracket extends along the second panel to thereby prevent movement of the second panel relative to the first panel. The detent is selectively depressed to thereby decouple the bracket from the first panel.

In certain examples, a method for assembling a container includes the steps of positioning a first panel adjacent to the second panel, wherein the first panel has a pin and a detent, positioning a bracket with a slot along the first panel such that the pin is in the slot and the bracket depresses the detent, and moving the bracket relative to the first panel such that the pin is in a leg of the slot and the detent automatically extends into the slot such that the bracket is fixed relative to the first panel.

In one exemplary embodiment of the present disclosure, the container is assembled from a plurality of side panels that each have at least a pair of side edges. The container can include a top panel and a bottom panel that are similar in size and thickness to the side panels. The container includes a plurality of edge brackets that are configured to join the side panels, the top panel and the bottom panel to define an open interior of the container. Each of the edge brackets includes a first channel member and a second channel member that are joined to each other. The first channel member includes a first receiving channel while the second channel member includes a second receiving channel. The first and second channels are each sized to receive the side edge of one of the side panels. The first and second channels are oriented perpendicular to each other such that when the side panels are received by the edge bracket, the side panels are perpendicular to each other.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
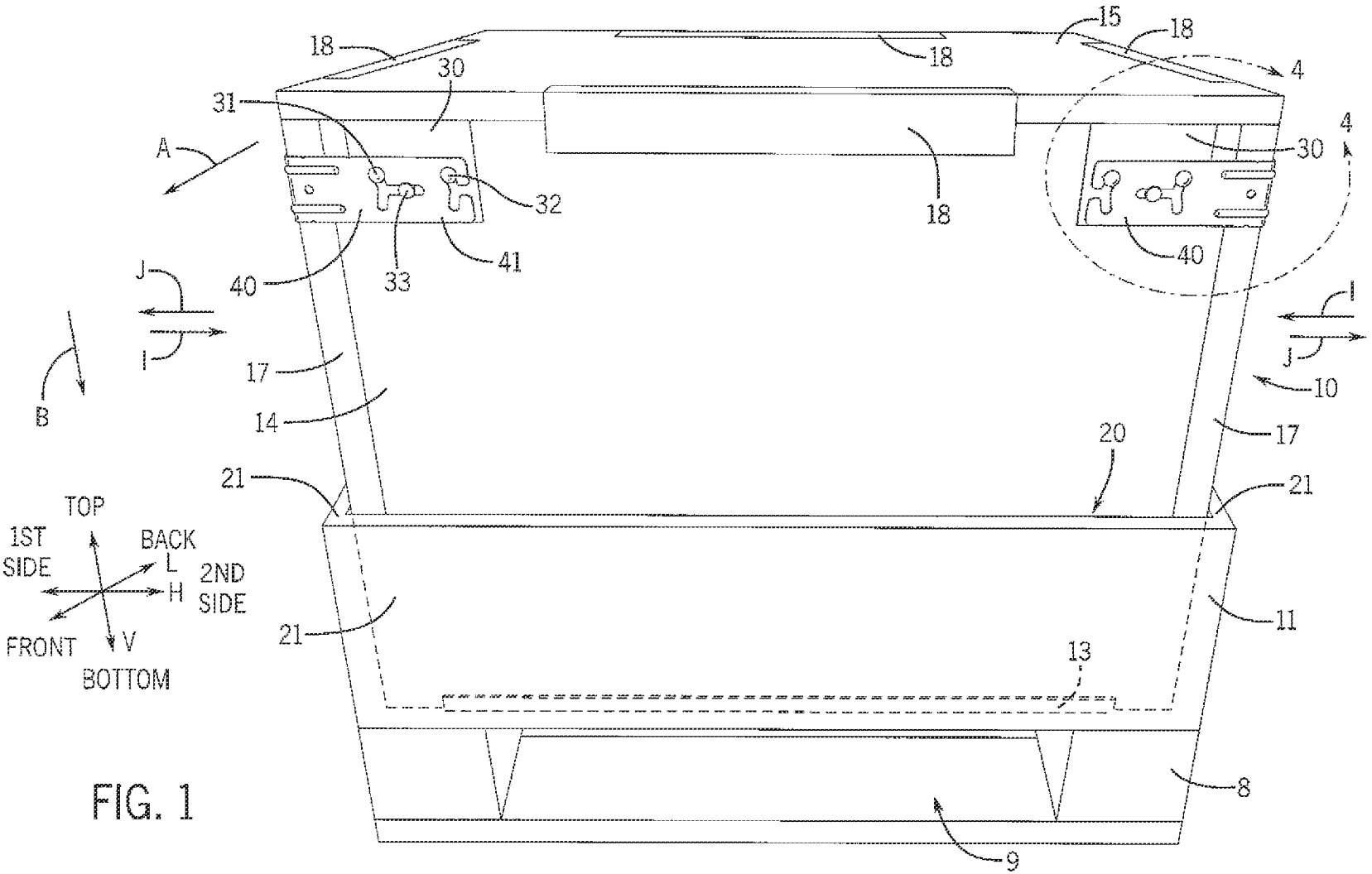
FIG. 1 is a perspective view of an example container with side panels assembled and received on a bottom panel and edge brackets securing the side panels to each other.
Figure 2:
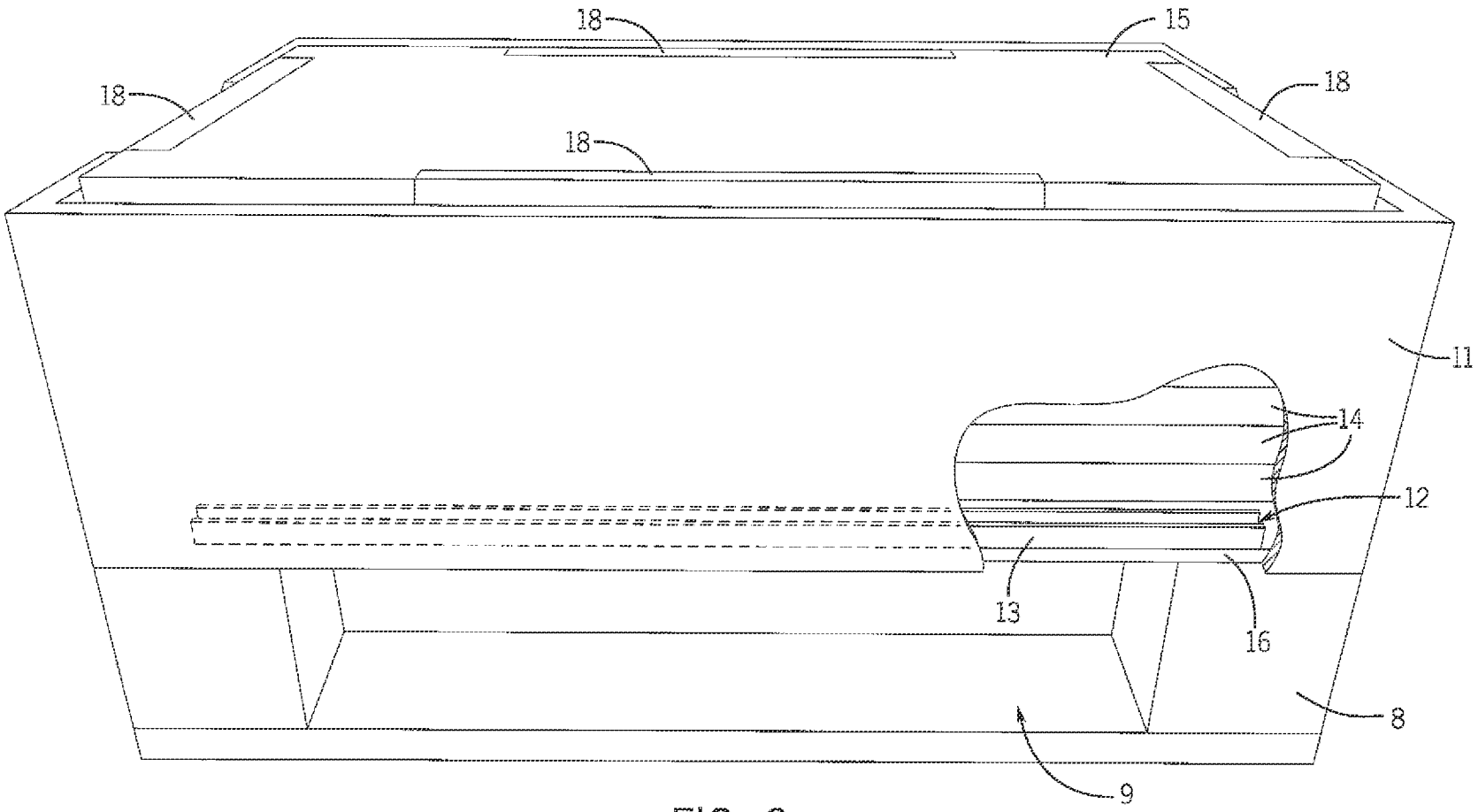
FIG. 2 is a perspective view of an example container system with panels stacked in the base.

FIGS. 1-2 depict an example container 10 of the present disclosure in which cargo is received. As depicted in FIG. 1, the container 10 is formed by a plurality of panels 14, 15, 16 that are stacked within a base 11. When assembled, the container 10 defines an internal cavity 23 (FIG. 4) in which cargo is contained. Note that the container 10 generally extends along a vertical axis (see arrow V) between a top and a bottom, a lateral axis (see arrow H) between a front and a back, and a longitudinal axis (see arrow L) between a first side and an opposite second side. The containers 10 are formed by any suitable material such as metal, plywood, corrugated cardboard, and solid wood.

Also note that although FIG. 1 depicts only one side panel 14 and a top panel 15, the container 10 includes additional side panels 14 (see FIG. 4) and a bottom panel 16 (see FIG. 2). The shape of the container 10 can vary, and in one example, the container 10 has a total of four side panels 14 such that the container 10 has a generally a rectangular prism.

The side panels 14 are joined to each other to defined the container by a series of edge brackets 17 that both protect the ends and edges of the side panels 14 and provide the means for attaching the side panels 14 to each other and to the top and bottom panels 15, 16. The edge brackets 17 are coupled to the side panels 14 and the top and bottom brackets 15, 16 with adhesives or fasteners, such as screws. The edge brackets 17 are L-shaped, U-shaped or other similar configuration and are formed of any suitable material such as metal and plastic. Further details of the edge brackets 17 are shown in FIG. 13-19 as will be fully described below.

Each side panel 14 can also include one or more mounting plates 30 that each include a first pin 31, a second pin 32, and a detent 33 extending therefrom. The mounting plates 30 are on an exterior surface of the side panel 14 that is opposite an interior surface that faces an internal cavity 23 (FIG. 4) formed by container 10. As such, the first pin 31, the second pin 32, and the detent 33 extend outwardly in a forward or first direction (see arrow A) away from the exterior surface of the container 10. Each pin 31, 32 has a pinhead 35 and a shaft 36 (FIG. 12) that extends between the mounting plate 30 and the pinhead 35. The pinhead 35 is enlarged relative to the cross-section or diameter of the shaft 36. The pins 31, 32 are aligned with each other in the lateral direction and the detent 33 is offset from the pins 31, 32 (e.g., the pins 31, 32 are positioned along a common line and the detent 33 is not positioned along the common line). For instance, the detent 33 is vertically offset from pins 31, 32. In certain examples, the pins 31, 32 are fixed on the side panel 14. In certain examples, the number of pins can vary (e.g., only one pin extends from the mounting plate, four pins extend from the mounting plate).

Figure 4:
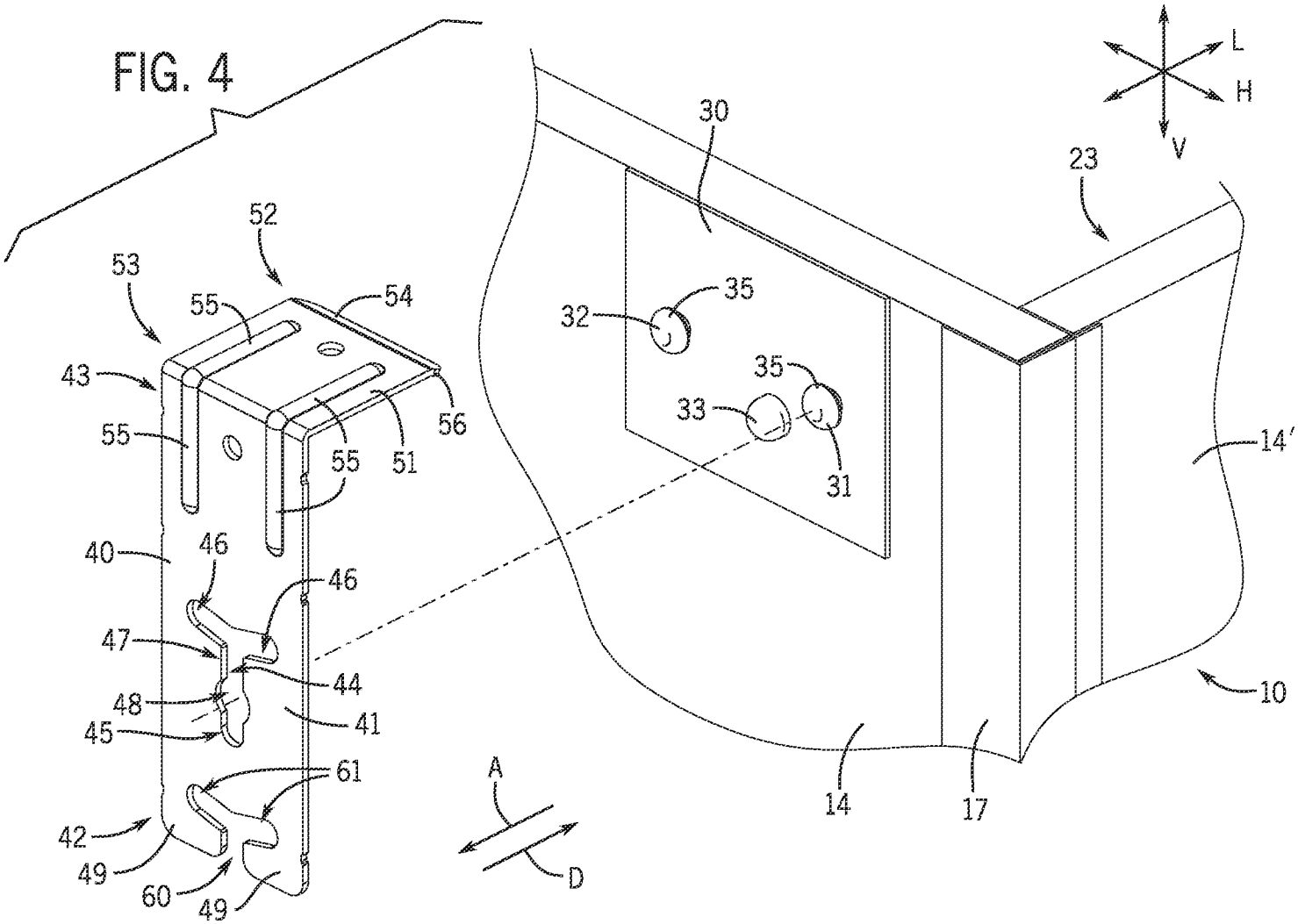
FIG. 4 is an exploded view showing the bracket removed from a container panel.

The number of mounting plates 30 on each side panel 14 can vary, and in one example, two mounting plates 30 are coupled to the top portions of two opposing side panels 14. Note that in certain examples, pins 31, 32 and the detent 33 are coupled directly to the exterior surface of the side panel 14 such that the mounting plate 30 can be excluded. Brackets 40 (described further herein) are coupled to each mounting plate 30 to thereby prevent movement of adjacent side panels 14 (described further herein) and/or secure the shape of the container 10. In one example, the brackets 40 prevent movement of the side panels 14 in an outward direction (see arrows J on FIG. 1) relative to the center of the internal cavity 23 (FIG. 4).

The top panel 15 rests on top of the side panels 14 and defines the top of the container 10. The top panel 15 has one or more lips 18 that extend from the sides or edges of the top panel 15. Thus, when the top panel 15 is placed on top of the side panels 14, the lips 18 extend in a second or downward direction (see arrow B on FIG. 1) and along the exterior surfaces of the side panels 14. Therefore, the lips 18 prevent the top portions of the side panels 14 from bowing outwardly. The lips 18 are coupled to the top panels 15 with adhesives or fasteners such as screws. The lips 18 are L-shaped and formed with any suitable material such as metal and plastic.

The bottom panel 16 (FIG. 2) rests on the base 11 and has a plurality of channels 12 that receive bottom ends of the side panels 14. Accordingly, the side panels 14 are prevented from inwardly moving or bowing. That is, when the side panels 14 are in the channels 12, the side panels do not move in an inward direction (see arrow I on FIG. 1) relative to the center of the internal cavity 23 (FIG. 4). The bottom panel 16 defines the bottom of the container 10 and the side panels 14 are vertically supported when the side panels 14 are in the channels 12. The channels 12 are defined U-shaped support members 13 that vertically upwardly extend toward the top of the container 10. In other examples, the channels 12 are recessed in the bottom panel 16.

The bottom panel 16 rests on the base 11, and thus, the container 10 rests on the base 11 when constructed. The base 11 has a recessed chamber 20 in which the container 10 sits such that the bottom panel 16 and the lower portions of the side panels 14 are in the chamber 20. Sidewalls 21 of the base 11 define the sides of the chamber 20. Furthermore, as depicted in FIG. 2, when the container 10 is disassembled (e.g., the panels 14, 15, 16 are decoupled from each other and no longer form the container), the chamber 20 advantageously receives the panels 14, 15, 16. That is, when the container 10 is disassembled or collapsed, the panels 14, 15, 16 are advantageously positioned in the chamber 20 in a stacked configuration (see FIG. 2). Accordingly, the panels 14, 15, 16 can be easily stored in the base 11. Optionally, the base 11 rests on a pedestal 8 having fork-receiving openings 9 or a convention pallet (not shown). Thus, the base 11 and the container 10 (either assembled or disassembled) is easily transported on the pedestal 8. Note that in certain examples, the base panel 16 is excluded and the channels 12 are in the base 11.

Figure 3:
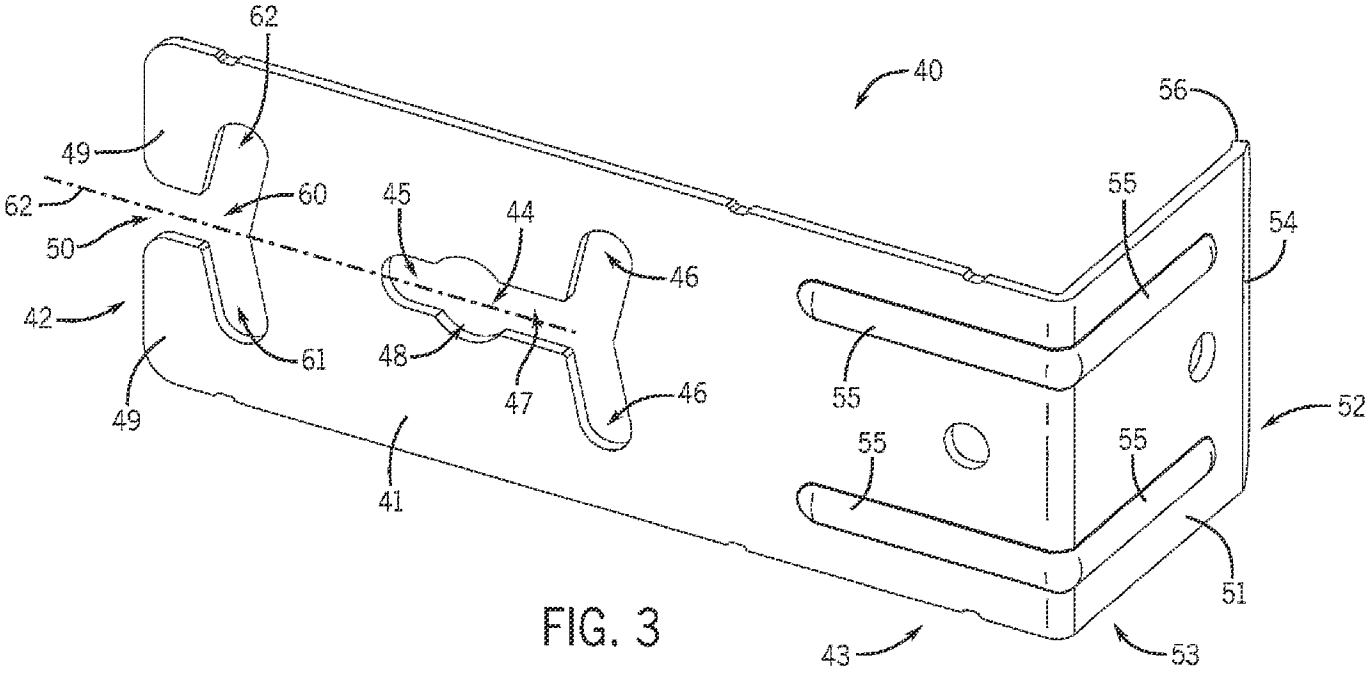
FIG. 3 is a perspective view of an example bracket according to the present disclosure.

As noted above, a bracket 40 is selectively coupled to each mounting plate 30 on the side panels 14, to thereby prevent movement of adjacent side panels 14 (described further herein). Referring now to FIG. 3, the bracket 40 is depicted in greater detail. The bracket 40 has a first arm 41 and a second arm 51 that is fixedly coupled to the first arm 41 such that the first arm 41 extends transverse to the second arm 51. The first arm 41 has a free first end 42 and an opposite second end 43 that is coupled to a second end 53 of the second arm 51. The second arm 51 also has a free first end 52 with an end portion 54 that extends transverse to the remaining portion of the second arm 51. Thus, the end portion 54 has an edge 56 that is configured to engage the exterior surface of a side panel 14 when the bracket 40 is coupled to the mounting plate 30. The second arm 51 includes stiffening elements 55 (e.g., welds, recessed channels such that the material on second arm 51 opposite the channel "bulges" outwardly) that stiffen the second arm 51 and prevent bending of the second arm 51. The first arm 41 also includes stiffening elements 55 that stiffen the first arm 41 and prevent bending of the first arm 41. Certain stiffening elements 55 of the first arm 41 and the second arm 51 are contiguous with each other such that these stiffening elements 55 prevent inadvertent bending of the first arm 41 relative to the second arm 51.

The first arm 41 has a first slot 44 and a second slot 60 that is spaced apart from the first slot 44. The first slot 44 has a head 45, a pair of opposing legs 46, and a body 47 that extends between the head 45 and the legs 46. The body 47 has an enlarged section 48 through which the pinhead 35 of the first pin 31 passes. That is, the width or diameter of the enlarged section 48 is greater than or equal to the width or diameter of the pinhead 35 of the first pin 31. The width of the other sections of the body 47, the head 45, and the legs 46 is less than the width or diameter of the pinhead 35 of the first pin 31. Thus, the pinhead 35 of the first pin 31 does not pass through the other sections of the body 47, the head 45, and the legs 46 and the pinhead 35 only passes through the enlarged section 48 (described further herein). Each leg 46 extends transverse to the body 47 and an angle is formed between the body 47 and each leg 46.

The second slot 60 is at the first end 42 of the first arm 41 such that the first end 42 of the first arm 41 has an opening 50 and two opposing prongs 49. Thus, the second pin 32 can pass between the prongs 49 into the second slot 60. The second slot 60 has a pair of opposing legs 61. Note that the width of the second slot 60 is less than the width or diameter of the pinhead 35 of the second pin 32. Thus, the second pin 31 only passes into or out of the second slot 60 when the bracket 40 is moved such that the second pin 31 is moved between the prongs 49. Each leg 61 extends away from each other and transverse to an axis 62. An angle is defined between the axis 62 and each leg 61. In certain examples, the angle defined between the axis 62 and one of the legs 61 is equal to the angle defined between the body 47 and one of the legs 46. In certain examples, the one leg 46 of the first slot 44 extending in the same direction as one leg 61 of the second slot 60. Note that the first arm 41 extends along the axis 62

FIGS. 4-15 depict an example sequence for coupling the bracket 40 to the mounting plate 30 that is on one of the side panels 14. Accordingly, as noted above, the bracket 40 prevents an adjacent side panel 14' from moving relative to the side panel 14 on which the mounting plate 30 is coupled. A person of ordinary skill in the art will recognize that the steps noted below may be combined with other steps. In certain examples, the side panels 14, 14' abut each other.

FIG. 4 depicts the one side panel 14 adjacent to another side panel 14'. The bracket 40 is spaced apart from the mounting plate 30 such that the enlarged section 48 of the first slot 44 is aligned with the first pin 31. The operator moves the bracket 40 in a fourth direction (see arrow D) toward the mounting plate 30 such that the first pin 31 passes through the enlarged section 48 of the first slot 44.

Figure 5:
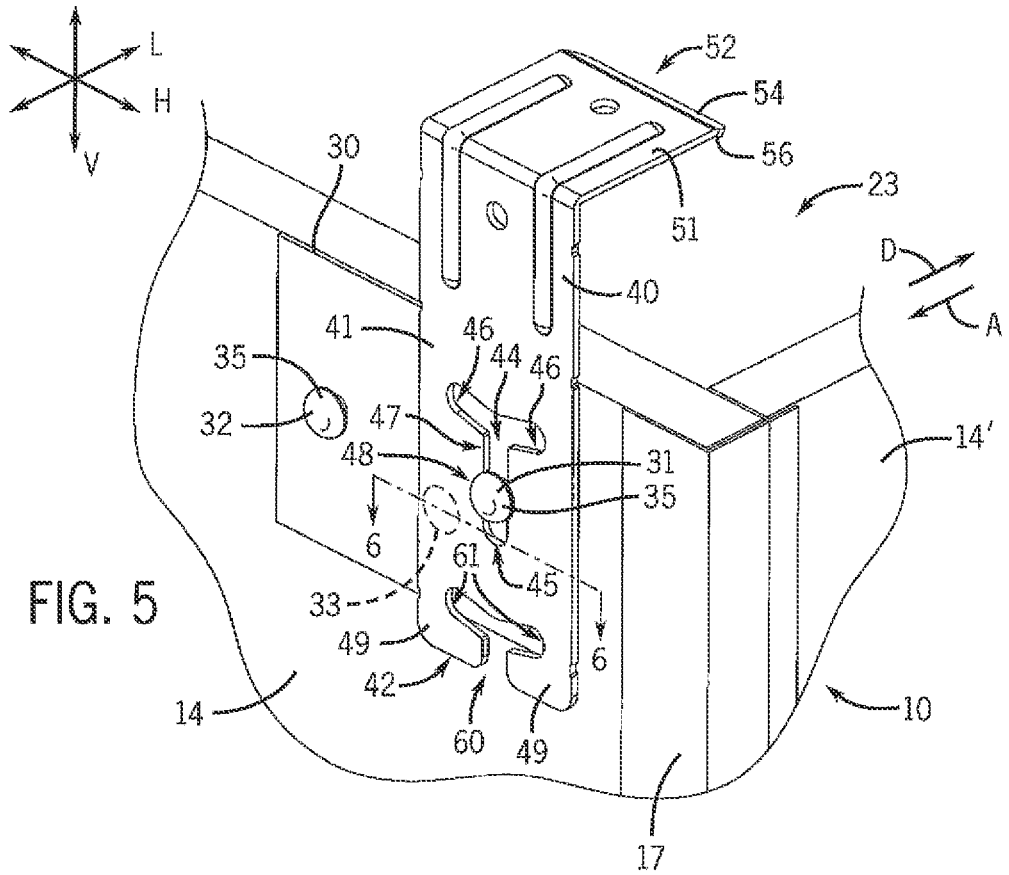
FIG. 5 is a partial view showing the attachment of the bracket to one of the container panels.
Figure 6:
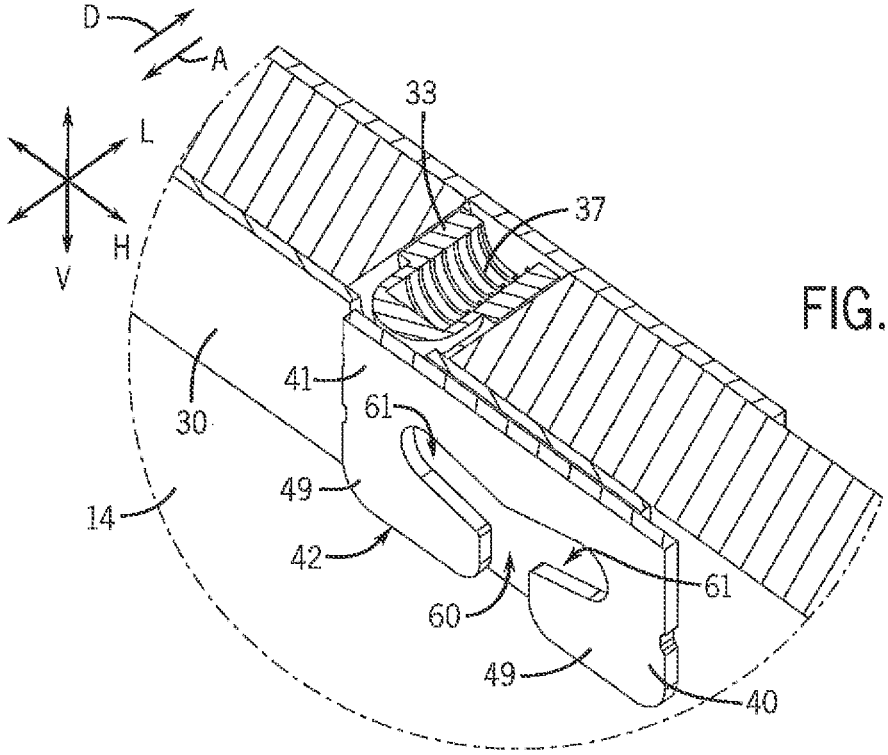
FIG. 6 is a cross-sectional view of the bracket and the panel taken along line 6-6 on FIG. 5.

Referring to FIGS. 5-6, as the first pin 31 passes through the enlarged section 48 of the first slot 44, the bracket 40 acts on and moves the detent 33 in the fourth direction (see arrow D). That is, the bracket 40 forces the detent 33 in the fourth direction (see arrow D) against a spring force exerted by a spring 37 (FIG. 6) that normally biases the detent 33 in a first direction (see arrow A). Thus, the spring 37 is compressed as the detent 33 is moved in the fourth direction (see arrow D). Note that the detent 33 is depicted in dashed lines on FIG. 5.

Figure 7:
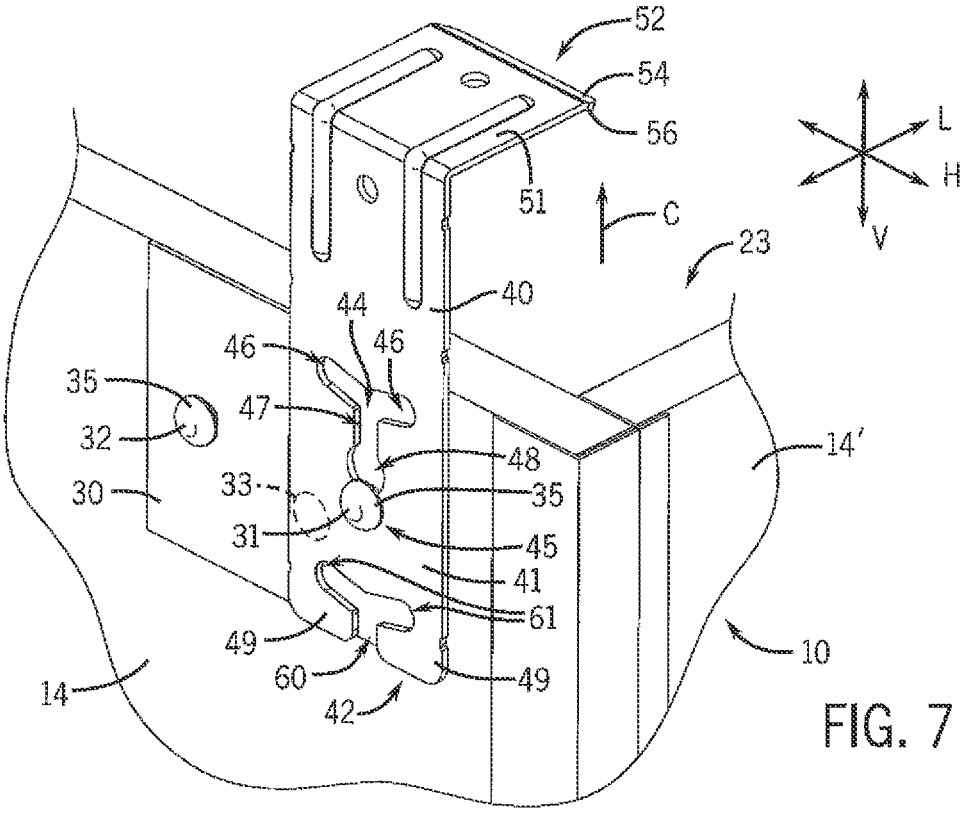
FIG. 7 is a view of the bracket in an upward position.

Referring to FIG. 7, after the first pin 31 passes through the enlarged section 48 of the first slot 44, the operator upwardly slides the bracket 40 in the third direction (see arrow C) such that the bracket 40 slides along the first pin 31 until the first pin 31 is at the head 45. Note that the pinhead 35 of the first pin 31 slides along the exterior surface of the bracket 40 while the shaft 36 (FIG. 12) of the first pin 31 slides in the first slot 44. Thus, the pinhead 35 prevents the bracket 40 from moving the first direction (see arrow A) away from the side panel 14. Note that the bracket 40 continues to act on the detent 33 as described above while the operator upwardly slides the bracket 40 in the third direction (see arrow C).

Figure 8:
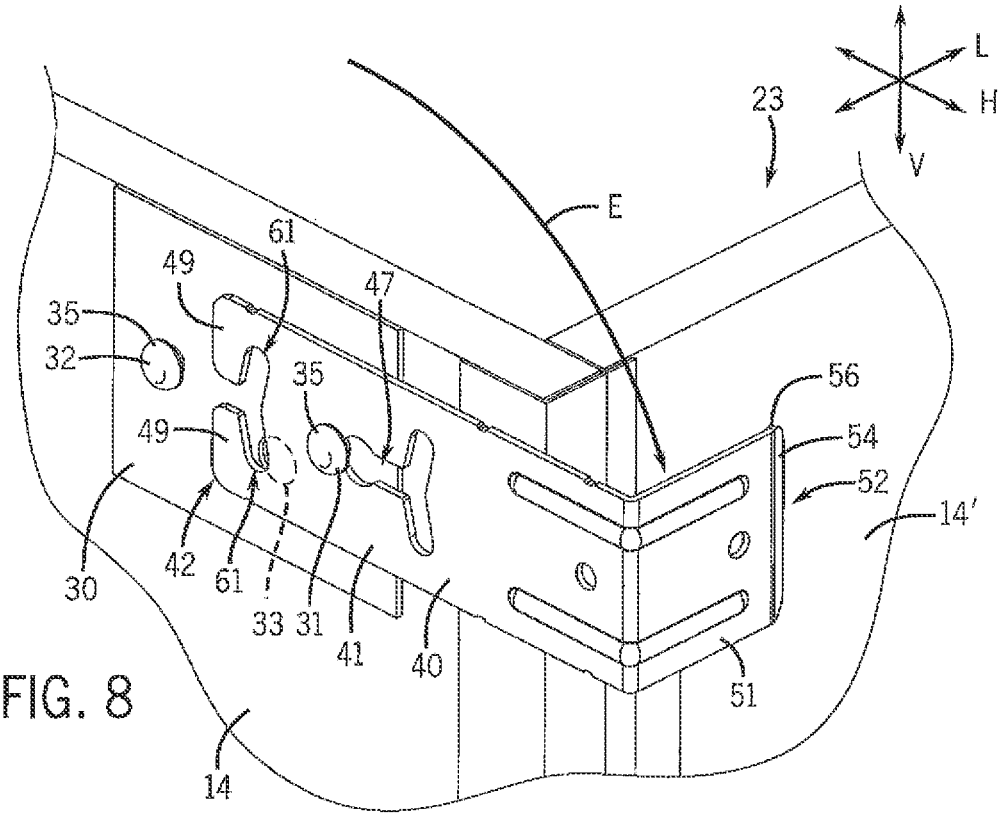
FIG. 8 is a view of the bracket in a rotated position.

FIG. 8 depicts the operator pivoting the bracket 40 about the first pin 31 in a first pivot direction (see arrow E; e.g., clockwise direction) such that the second arm 51 of the bracket 40 is along the adjacent side panel 14'. Note that the bracket 40 continues to act on the detent 33 as described above while the operator pivots the bracket 40.

Figure 9:
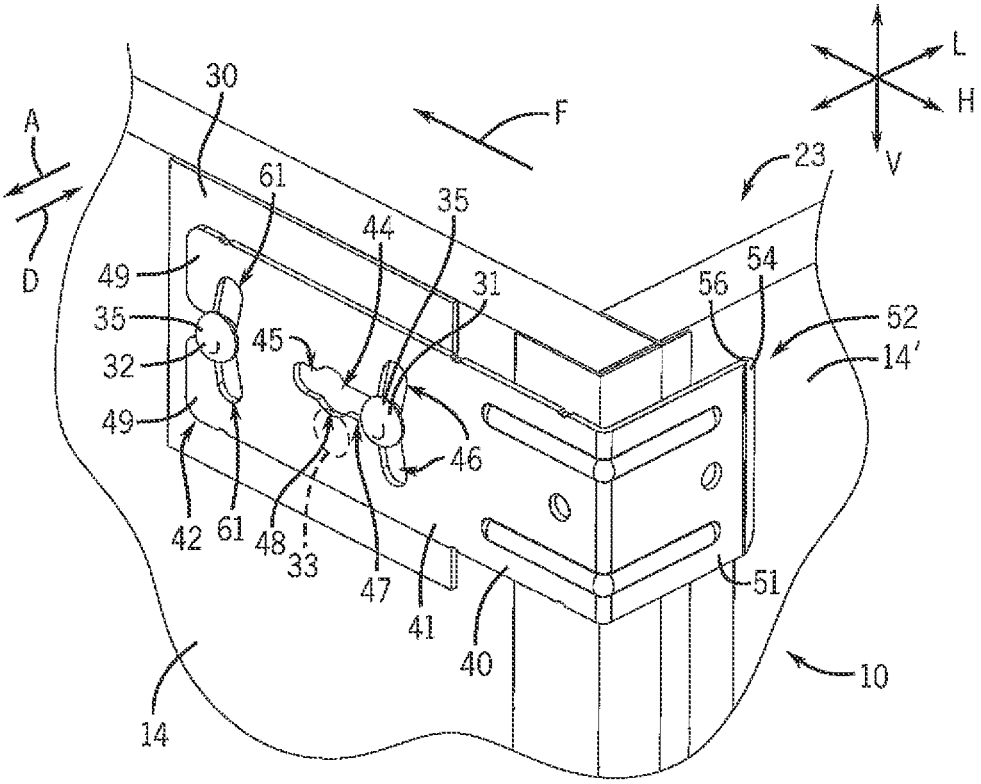
FIG. 9 is a view of the bracket in a retracted position.

The operator then slides the bracket 40 in a fifth direction (see arrow F), as depicted in FIG. 9, until the second pin 32 is in the second slot 60, the first pin 31 is near the legs 46 of the first slot 44, and the second arm 51 of the bracket 40 is along the adjacent side panel 14'. In certain examples, the edge 56 of the second arm 51 contacts the exterior surface of the adjacent side panel 14'. Note that the pinhead 35 of the second pin 32 is along the surface of the bracket 40 while the shaft 36 (FIG. 12) of the second pin 32 is in the second slot 60. Thus, the pinhead 35 of the second pin 32 also prevents the bracket 40 from moving in the first direction (see arrow A) away from the side panel 14 (e.g., the pinheads 35 of the first pin 31 and the second pin 32 retain the bracket 40 on the panel 14). Note that the bracket 40 continues to act on the detent 33 as described above while the operator slides the bracket 40 in the fifth direction (see arrow F).

Figure 10:
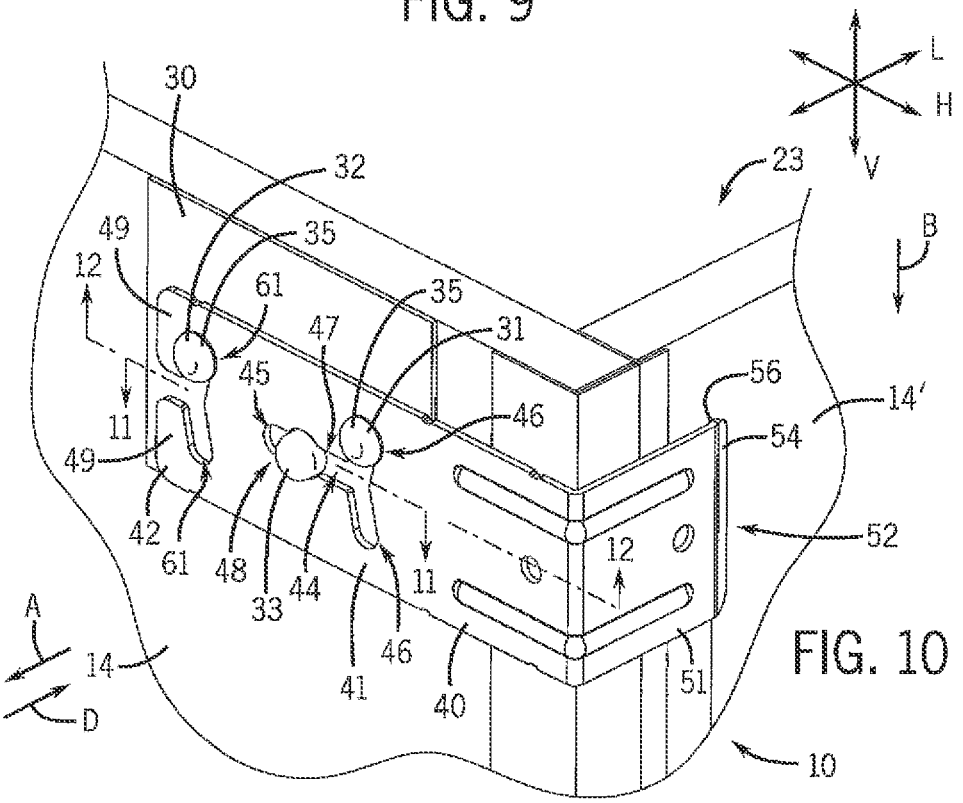
FIG. 10 is a view of the bracket in the locked position.
Figure 12:
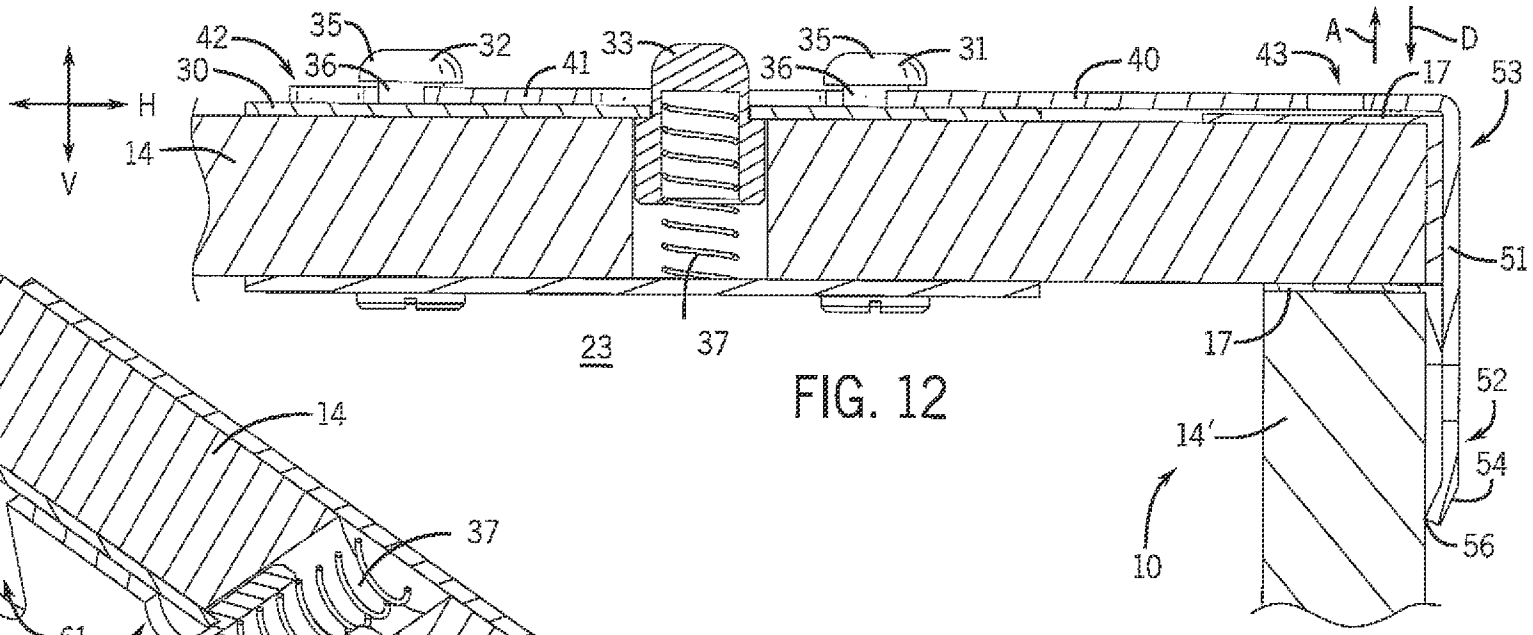
FIG. 12 is a section view of the bracket and panel taken along line 12-12 of FIG. 10.
Figure 11:
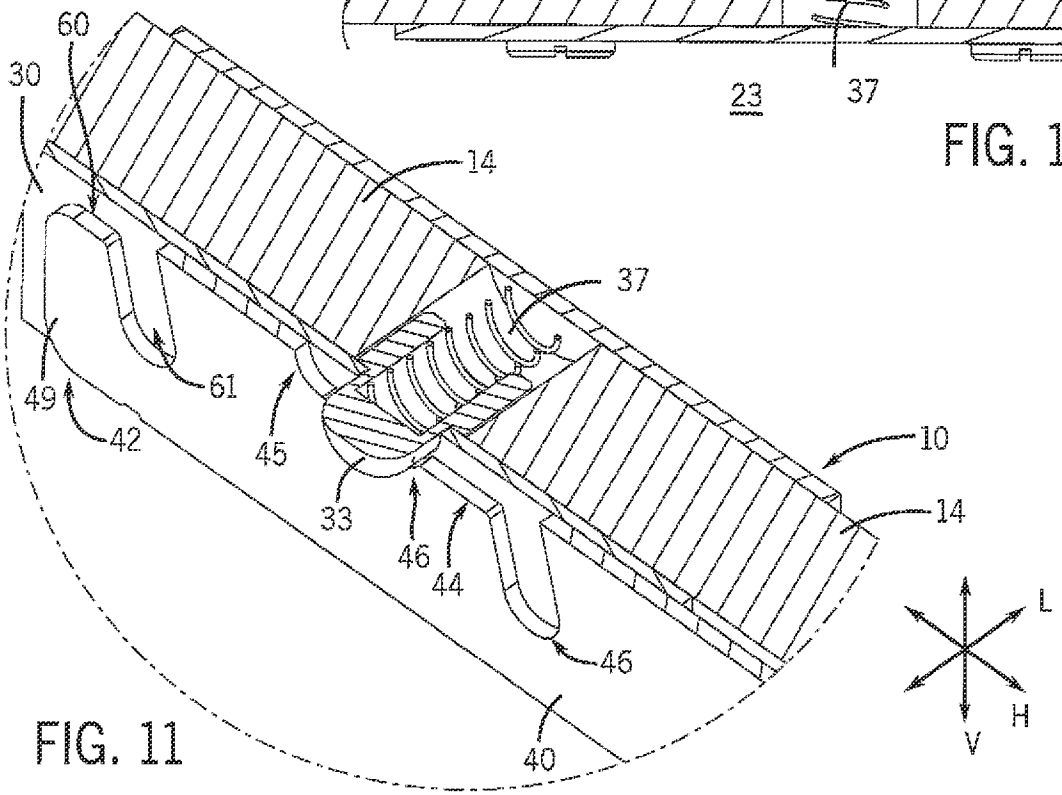
FIG. 11 is a section view of the bracket and the panel taken along line 11-11 of FIG. 10.

Referring now to FIGS. 10-12, the operator completes the coupling sequence (e.g., to fully secure or lock the bracket 40 into position on the mounting bracket 40) by sliding the bracket 40 generally downwardly (e.g., see second direction indicated by arrow B) such that the first pin 31 is in one of the legs 46 and the second pin 32 is in one of the legs 61. As the operator slides the bracket 40, the detent 33 is moved by the spring 37 (FIG. 12) in the first direction (see arrow A) such that the detent 33 extends through the enlarged section 48 of the first slot 44. As noted above, the detent 33 is offset from the pins 31, 32 (e.g., the detent 33 is vertically offset from the pins 31, 32) and accordingly, the bracket 40 is fixed in place on the mounting bracket 40. Thus, the second arm 51 of the bracket 40 is also fixed relative to the adjacent side panel 14' and thus, the bracket 40 creates a braced connection between the side panel 14 and the adjacent side panel 14' such that the bracket prevents the side panels 14, 14' from moving relative to each other.

The operator decouples the bracket 40 from the mounting bracket 40 (such as when the container 10 is to be disassembled or collapsed) by pressing the detent 33 in the fourth direction (see arrow D on FIG. 10) against the spring force applied by the spring 37 to the detent 33. Accordingly, the operator can then move (e.g., slide, pivot) the bracket 40 in different directions to decouple the bracket 40 from the mounting plate 30. Note that a person of ordinary skill in the art will recognize that the directions the operator must moves the bracket 40 to decouple to the bracket 40 from the mounting plate 30 are generally opposite the directions noted above with respect to the example coupling sequence for coupling the bracket 40 to the mounting plate 30.

Note that the legs 46, 61 of the slots 44, 60, respectively, are advantageously arranged such that the bracket 40 can be used on any side panel 14 of the container. For instance, FIGS. 4-12 depict the bracket 40 on a right side of the container 10. However, the bracket 40 could be "flipped" and used on the opposite, left side of the container 10.

Figure 13:
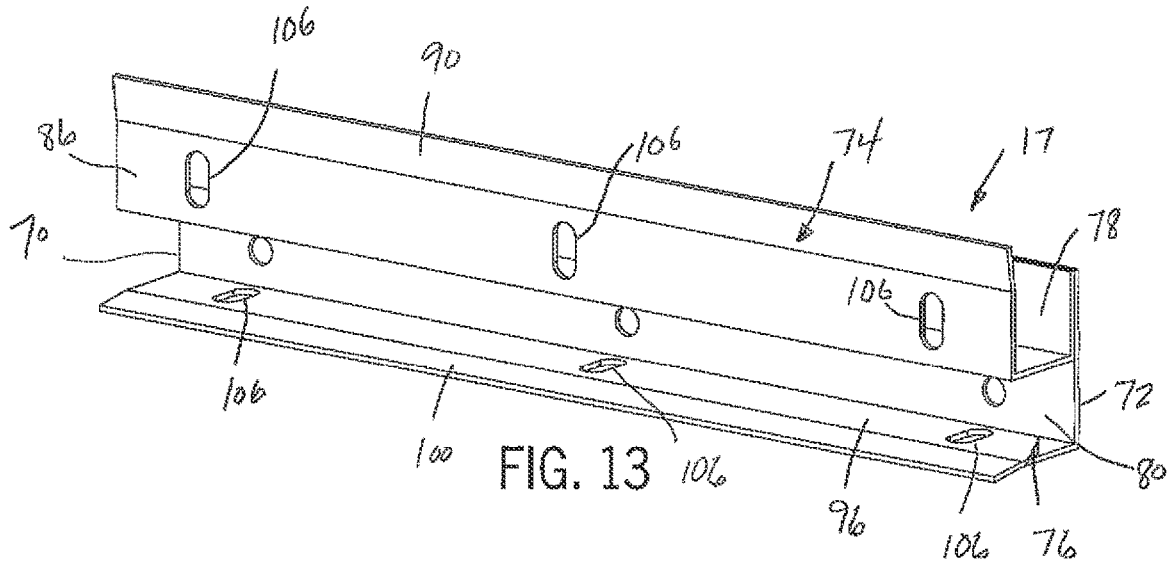
FIG. 13 is a front perspective view of an edge bracket in accordance with an exemplary embodiment of the present disclosure.
Figure 14:
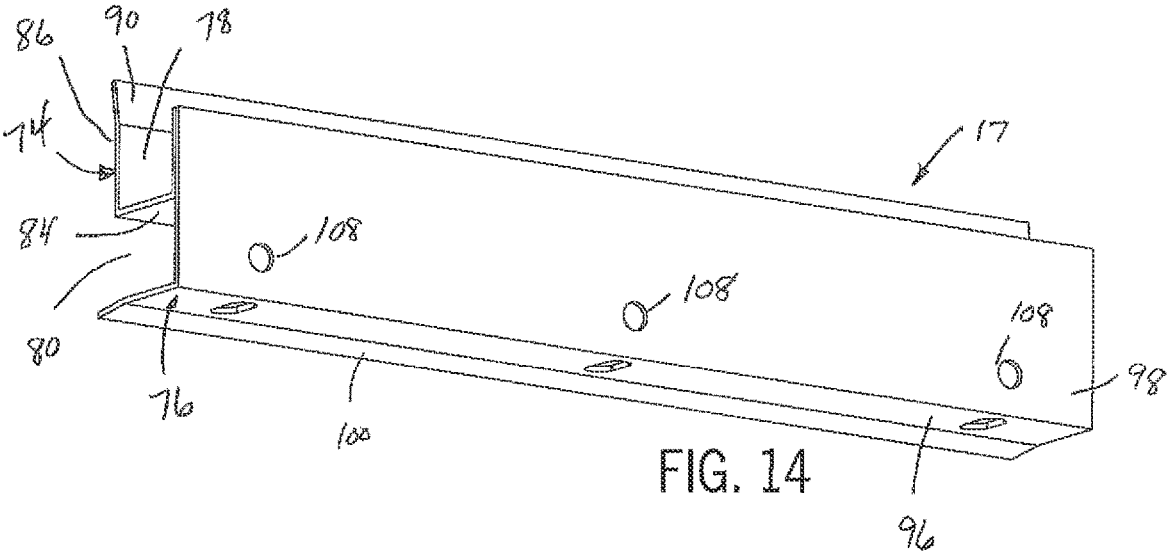
FIG. 14 is a back perspective view of the edge bracket of the exemplary embodiment of the present disclosure.
Figure 15:
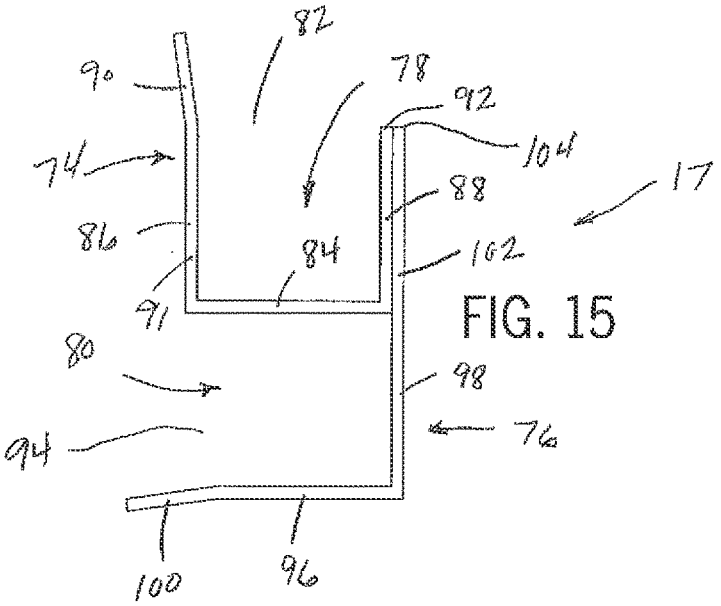
FIG. 15 is a side view of the edge bracket.

As illustrated in FIGS. 1, 4 and 12, adjacent side panels 14 of the container 10 are joined to each other by an edge bracket 17 that is positioned at the perpendicular intersection between the side panels 14. The edge bracket 17 can also be used to join the side panels 14 to the top panel 15, as will be described below. The edge brackets 17 are each designed to allow the side panels 14 to be assembled to create the side walls of the container 10 and to define an open interior for the container. FIGS. 13-15 illustrate the details of the edge brackets 17 that are used to join the four side panels 14 used to form the collapsible container 10 of the present disclosure.

The edge bracket 17 shown in FIGS. 13-15 is formed from a metallic material and extends along a longitudinal length between a first end 70 and a second end 72. However, the edge bracket 17 could be formed from other durable materials, such as plastic or nylon. When the edge bracket 17 is used to form the corners of the container between adjacent side panels, the longitudinal length of the edge bracket 17 generally corresponds to the height of each of the side panels 14. In such embodiment, the edge bracket 17 extends along the entire height of each of the side panels when the container is constructed as shown in FIG. 1.

The edge bracket 17 is formed from two separate components that are joined to each other to create the edge bracket 17. In the embodiment shown, a first channel member 74 and a second channel member 76 are joined to each other to form the integrated edge bracket 17. The first channel member 74 is shaped and configured to define a first receiving channel 78 while the second channel member 76 is shaped and configured to define a second receiving channel 80. The first and second receiving channels 78, 80 each extend along the entire longitudinal length of the edge bracket 17 between the first end 70 and the second end 72. As can be seen in FIG. 15, the first receiving channel 78 and the second receiving channel 80 are oriented such that the first and second receiving channels 78, 80 are perpendicular to each other.

The first receiving channel 78 includes an open end 82 and is defined by a back wall 84, a first side wall 86 and a second side wall 88. The first and second side walls 86, 88 extend from opposite edges of the back all 84 and extend parallel to each other and perpendicular to the back wall 84. The width of the first receiving channel 78 is thus defined by the distance between the first side wall 86 and the second side wall 88. As shown in FIG. 15, the first side wall 86 includes an extended portion 90 that is angled slightly away from the lower portion 91 of the first side wall 86 to expand the effective width of the open end 82 above the top edge 92 of the second side wall 88. The angled orientation of the extended portion 90 allows for a side edge of one of the side panels to enter into the first receiving channel 78 more easily as will be described in greater detail below.

The second channel member 76 partially defines the second receiving channel 80, which includes an open end 94. The second receiving channel 80 is defined by a side wall 96, a back wall 98 and the back wall 84 of the first channel member 74. The width of the second receiving channel 80 is defined by the distance between the side wall 96 and the back wall 84. The width of the second receiving channel 80 corresponds to the width of the first receiving channel 78, which in turn corresponds to the thickness of the side panels the form the container of the present disclosure. The side wall 96 includes an extended portion 100 that angles outward away from the open end 94 to expand the width of the open end 94 to allow the side edge of one of the side panels to more easily be received within the second receiving channel 80.

As most clearly shown in FIG. 15, the back wall 98 of the second receiving channel 76 extends past the back wall 84 of the first channel member such that the extended portion 102 of the back wall 98 is adjacent to the second side wall 88. The top edge 104 of the extended portion 102 is generally aligned with the top edge 92 of the second side wall 88. As can be seen in FIG. 15, the second side wall 88 is securely joined to the extended portion 102 of the back wall 98 such that the first channel member 74 is joined to the second channel member 78. In an embodiment in which the first channel member 74 and the second channel member 76 are each formed from a metal material, the first and second channel members 74, 76 can be joined to each other using any type of metal joining process, such as using an adhesive or a weld. In an embodiment in which the first channel member 74 and the second channel member 76 are formed from a plastic or nylon material, plastic and nylon joining methods, such as an adhesive or a heat weld, can be used to join the first and second channel members 74, 76. In each embodiment, the first and second channel members 74, 76 are securely joined to each other to create the edge bracket 17.

Referring to FIGS. 13 and 14, the first side wall 86 and the side wall 96 are each formed having a plurality of attachment openings 106 evenly spaced between the first end 70 and the second end 72 of the edge bracket 17. The attachment opening 106 are each designed to receive a connector, such as a screw or nail, to securely join the edge bracket 17 to the pair of joined side panels in a manner as will be described below. In addition to the attachment openings 106, the edge bracket 17 can include another series of attachment openings 108 formed in the lower portion of the back wall 98. The attachment openings 108 provide access to the second receiving channel 80 and the side edge of the side panel received therein. The series of attachment openings 106 and 108 allow the edge bracket 17 to be securely attached to a pair of side panels when the side panels are oriented perpendicular to each other to form the container.

Figure 16:
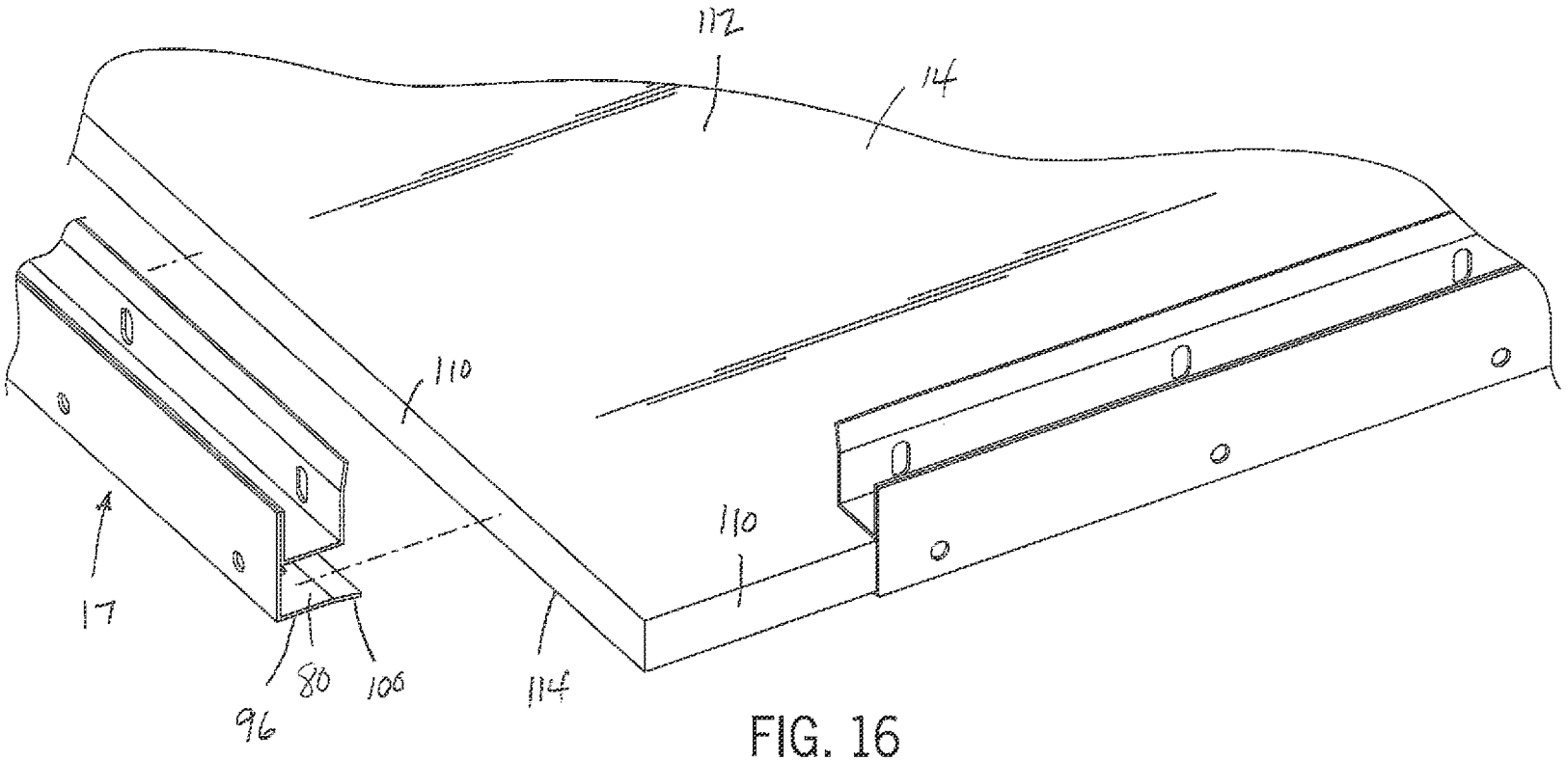
FIG. 16 is an exploded view showing the edge bracket and one of the plurality of panels.
Figure 17:
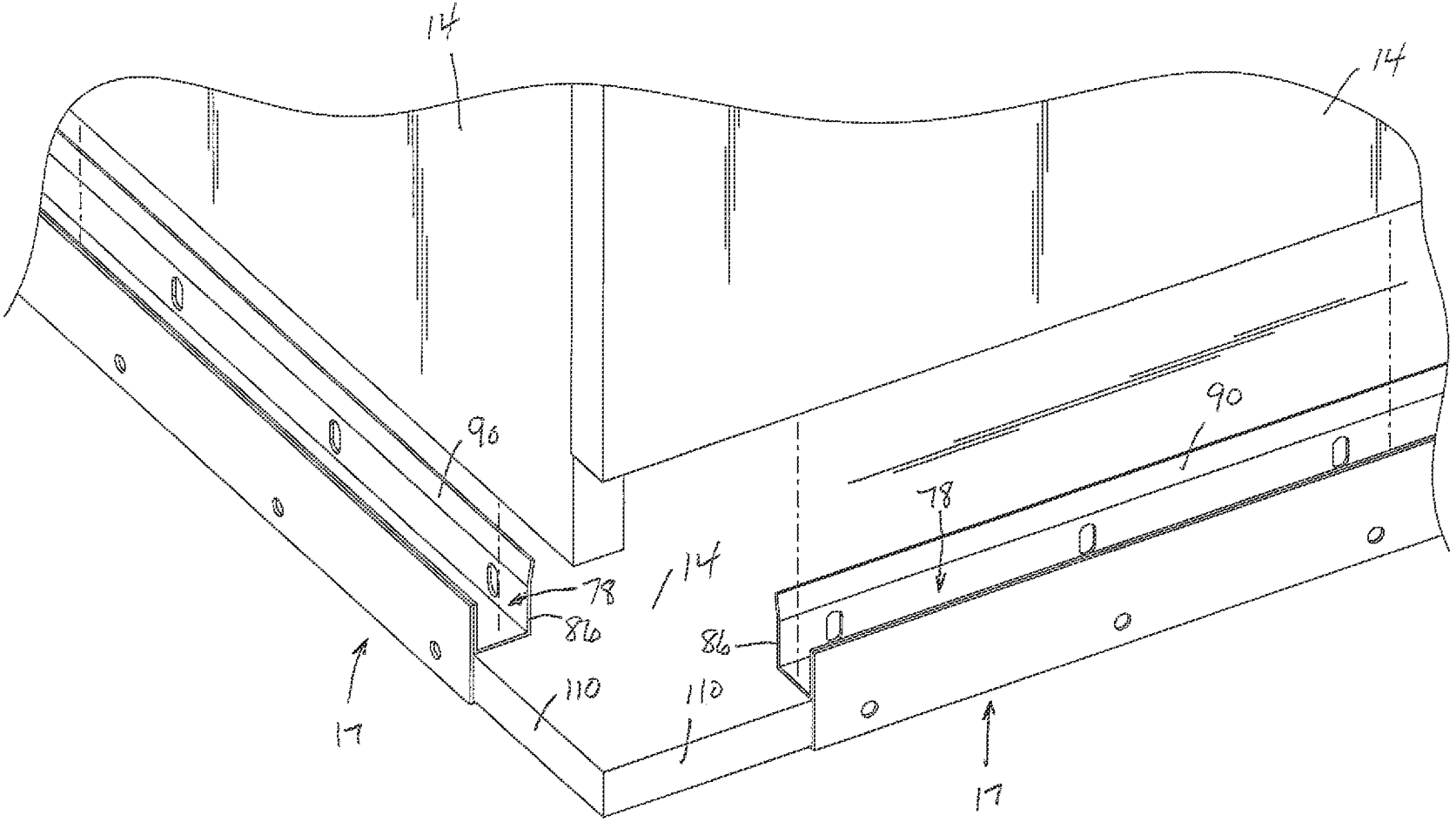
FIG. 17 is an exploded view showing two panels being received by a pair of edge brackets mounted to another of the panels.

FIG. 16 illustrates one of the side panels 14 that is used to form the collapsible container. The side panel 14 includes four side edges 110, two of which are shown in FIG. 16. The side edges 110 each have a thickness defined between the upper face 112 and the lower face 114. The thickness of the side edge 110 corresponds to the width of the second receiving channel 80 of the edge bracket 17. As illustrated in FIG. 16, the edge bracket 17 can be pressed onto the side edge 110 such that the edge bracket 17 moves from the detached position to a mounted position relative to the side panel 14, as shown in FIG. 16. As described previously, the side wall 96 includes an outer portion 100 that is angled slightly to expand the open end to facilitate the insertion of the side edge 110 into the second receiving channel 80.

Figure 18:
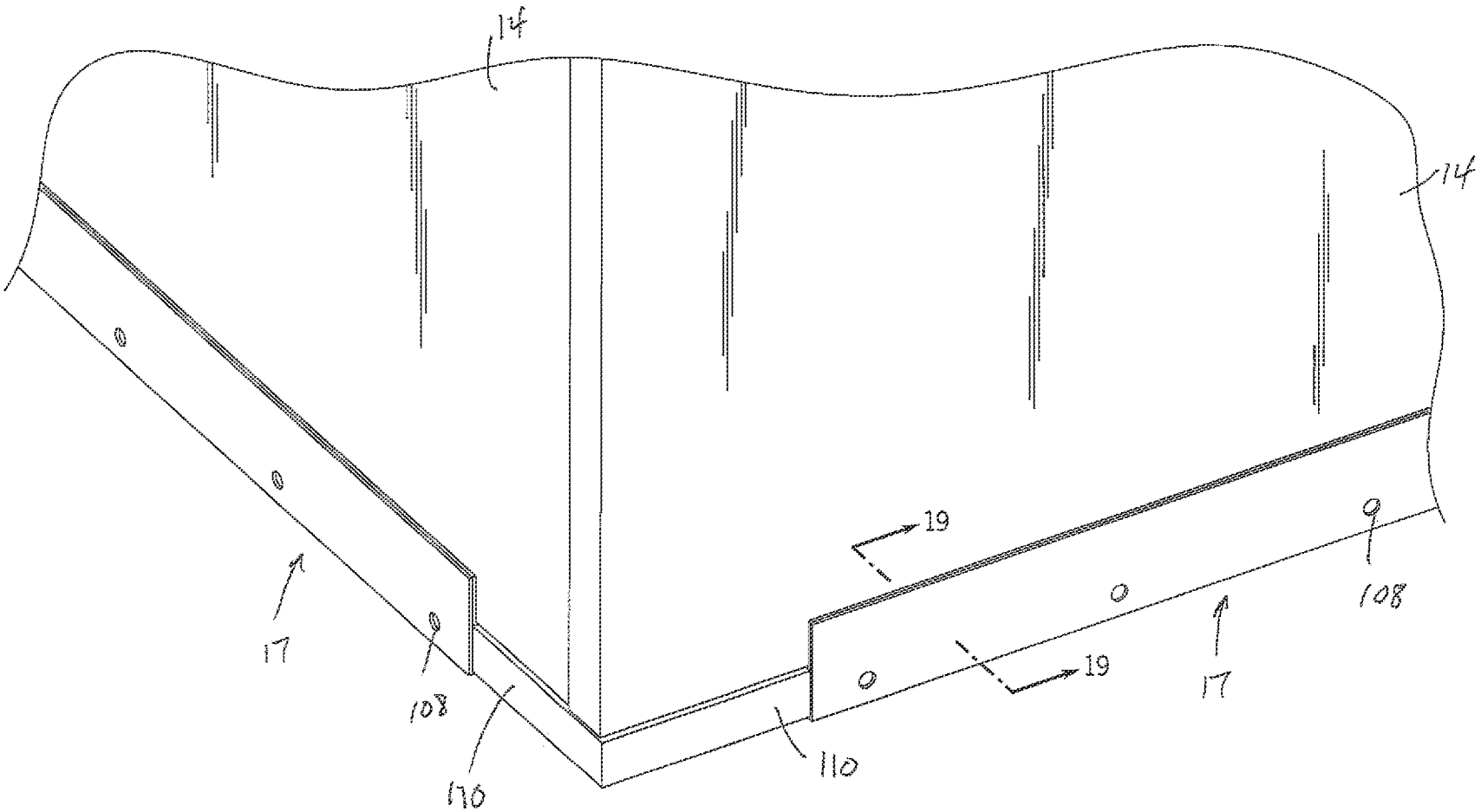
FIG. 18 is a view showing the two panels mounted to a base panel using the pair of edge brackets.

After the pair of edge brackets 17 are received on the side edges 110 of the side panel 14, two more side panels 14 can be inserted into the respective first receiving channels 78. Each of the first receiving channels 78 includes the open outer end which is expanded by the angled upper portion 90 of the first side wall 86. Once the side panels are received as shown in FIG. 18, connectors can be used in the attachment openings 108 to secure the edge bracket 17 to the side panel 14.

Figure 19:
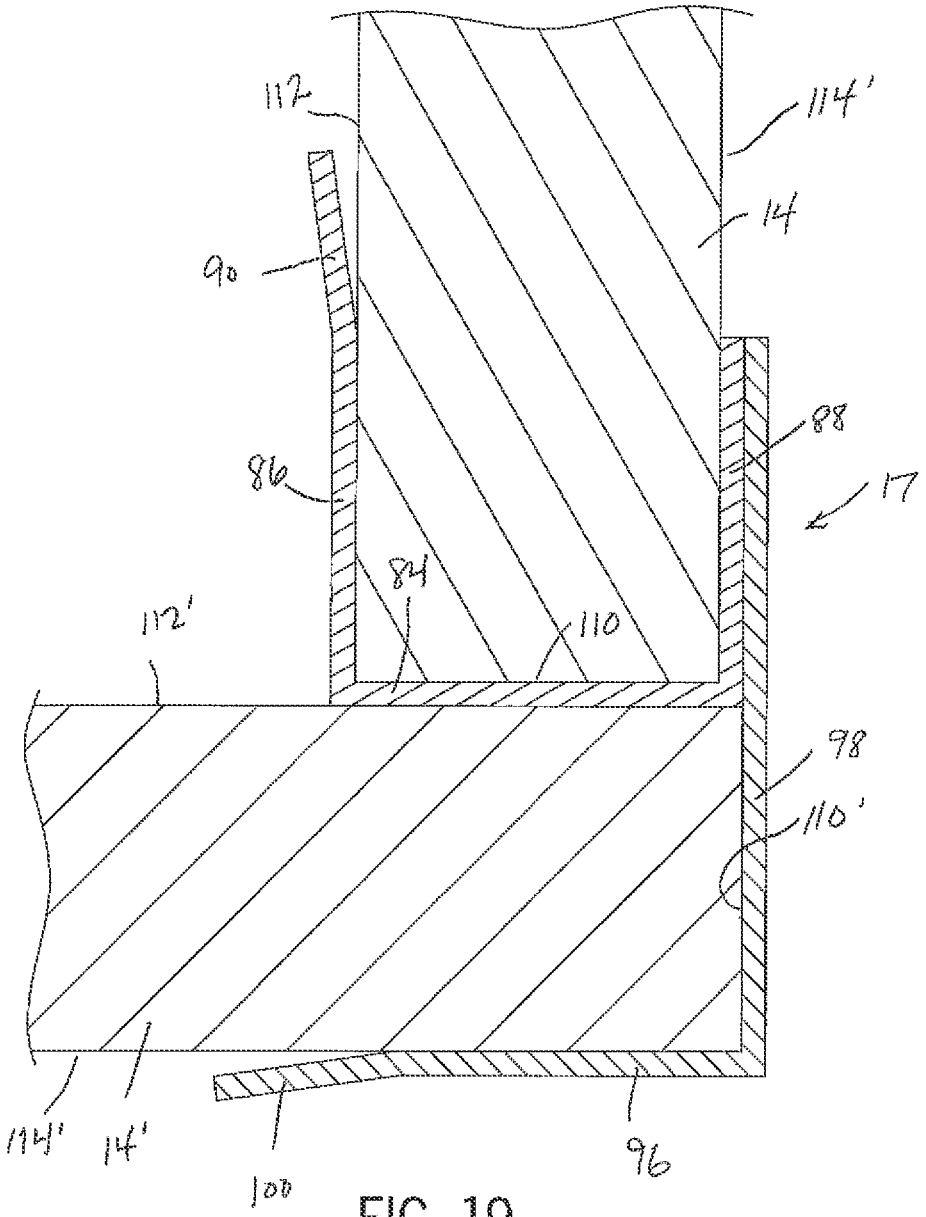
FIG. 19 is a section view taken along line 19-19 of FIG. 18.

FIG. 19 is a section view that illustrates the use of the edge brackets 17 to securely hold the pair of side panels 14 and 14' in a perpendicular orientation to each other. In this position, the side edge 110 of the first side panel contacts the back wall 84 and the pair of spaced side walls 86 and 88. The upper portion 90 is positioned at an angle outward such that it is spaced from the face 112 of the side panel. The second side panel 14' includes a side edge 110' that contacts the back wall 98. The face 112' is in contact with the back wall 84 while the face 114' is in contact with the side wall 96. The outer portion 100 extends away from the face 114' to facilitate the insertion of the side panel 14'.

When the pair of side panels 14 are inserted and installed as shown in FIG. 19, connectors can then be used to join the first and second channel members 74, 76 to the pair of side panels. The connectors are positioned to extend through the attachment openings 106, which are best shown in FIG. 13. In this manner, the edge brackets 17 can be each used to join a pair of perpendicular side panels.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A container comprising:

a plurality of side panels each having a pair of side edges;

a plurality of edge brackets configured to join the plurality of side panels to define an open interior of the container, wherein each of the edge brackets comprises:

a first channel member that includes a first receiving channel sized to receive the side edge of a first side panel, wherein the first receiving channel of the first channel member is defined by a back wall, a first side wall and a second side wall, where the first and second side walls are joined to the back wall and extend perpendicular to the back wall; and a second channel member that includes a second receiving channel sized to receive the side edge of a second side panel, wherein the second receiving channel of the second channel member is defined by a back wall, a side wall and the back wall of the first receiving channel, wherein the first and second channel members are oriented such that the first and second receiving channels are perpendicular to each other.

2. The container of claim 1, wherein the second side wall of the first channel member is adjacent to and joined to an extended portion of the back wall of the second channel member.

3. The container of claim 1 further comprising a top panel and a bottom panel that are each joined to the plurality of side panels that are joined to each other by the plurality of edge brackets.

4. The container of claim 2 wherein the back wall of the second channel member extends past the back wall of the first channel member to form the extended portion that is joined to the second side wall of the first channel member.

5. The container of claim 1 wherein the plurality of edge brackets are each formed from a metal material.

6. The container of claim 1 wherein the first side wall of the first channel member and the side wall of the second channel member each include a plurality of attachment openings.

7. An edge bracket for joining two side panels that each have at least a pair of side edges, the edge bracket comprising:

a first channel member that includes a first receiving channel sized to receive the side edge of a first side panel, wherein the first receiving channel of the first channel member is defined by a back wall, a first side wall and a second side wall, where the first and second side walls are joined to the back wall and extend perpendicular to the back wall; and a second channel member that includes a second receiving channel sized to receive the side edge of a second side panel, wherein the second receiving channel of the second channel member is defined by a back wall, a side wall and the back wall of the first receiving channel, wherein the first and second channel members are oriented such that the first and second receiving channels are perpendicular to each other.

8. The edge bracket of claim 7, wherein the second side wall of the first channel member is adjacent to and joined to an extended portion of the back wall of the second channel member.

9. The edge bracket of claim 7 wherein the back wall of the second channel member extends past the back wall of the first channel member to form the extended portion that is joined to the second side wall of the first channel member.

10. The edge bracket of claim 7 wherein the edge bracket is formed from a metal material.

11. The edge bracket of claim 7 wherein the first side wall of the first channel member and the side wall of the second channel member each include a plurality of attachment openings.

12. The edge bracket of claim 7 wherein a width of the second receiving channel is defined by a distance between the side wall of the second receiving channel and the back wall of the first receiving channel.

13. The edge bracket of claim 7 wherein the first side wall of the first channel member extends further from the back wall of the first channel member than the second side wall of the first channel member to define a first side wall extension and the side wall of the second channel member extends further from the back wall of the second channel member than the back wall of the first channel member to define a second side wall extension.

14. The edge backet of claim 13 wherein first side wall extension extends at an angle away from the first receiving channel and the second side wall extension extends at an angle away from the second receiving channel.

15. The container of claim 1 wherein the first side wall of the first channel member extends further from the back wall of the first channel member than the second side wall of the first channel member to define a first side wall extension and the side wall of the second channel member extends further from the back wall of the second channel member than the back wall of the first channel member to define a second side wall extension.

16. The container of claim 15 wherein first side wall extension extends at an angle away from the first receiving channel and the second side wall extension extends at an angle away from the second receiving channel.

* * * * *